US008180257B2

(12) United States Patent
Matsunai

(10) Patent No.: US 8,180,257 B2
(45) Date of Patent: May 15, 2012

(54) PHOTOCONDUCTIVE IMAGE FORMING APPARATUS WITH RETRACTABLE SHUTTER UNIT

(75) Inventor: Tomohiro Matsunai, Kanagawa-ken (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 87 days.

(21) Appl. No.: 12/795,640

(22) Filed: Jun. 7, 2010

(65) Prior Publication Data

US 2010/0310274 A1 Dec. 9, 2010

Related U.S. Application Data

(60) Provisional application No. 61/184,713, filed on Jun. 5, 2009.

(51) Int. Cl.
*G03G 15/00* (2006.01)
*G03G 15/16* (2006.01)

(52) U.S. Cl. ..... 399/207; 399/110; 399/118; 399/299

(58) Field of Classification Search ..... 399/207, 399/110, 114, 118, 298, 299, 302
See application file for complete search history.

(56) References Cited

U.S. PATENT DOCUMENTS

| | | | | |
|---|---|---|---|---|
| 7,705,871 | B2 * | 4/2010 | Imamura et al. | 399/118 X |
| 2007/0014587 | A1 | 1/2007 | Hasebe | |
| 2007/0041754 | A1 | 2/2007 | Hachisuga et al. | |
| 2007/0059051 | A1 | 3/2007 | Kaiho | |
| 2007/0059054 | A1 | 3/2007 | Furukawa | |
| 2007/0231000 | A1 | 10/2007 | Otake et al. | |
| 2007/0231001 | A1 | 10/2007 | Kaiho et al. | |
| 2010/0183335 | A1 * | 7/2010 | Matsuo et al. | 399/207 |

FOREIGN PATENT DOCUMENTS

| | | |
|---|---|---|
| JP | 3-4249 | 1/1991 |
| JP | 2005-266533 | 9/2005 |

* cited by examiner

*Primary Examiner* — Sophia S Chen
(74) *Attorney, Agent, or Firm* — Patterson & Sheridan, LLP

(57) ABSTRACT

An image forming apparatus includes a light irradiation unit configured to irradiate light on the surface of a photoconductive member and form an electrostatic latent image, a developing unit configured to form a developer image corresponding to the electrostatic latent image on the surface of the photoconductive member, a transfer belt configured to move between a first position where the transfer belt comes into contact with the photoconductive member and a second position where the transfer belt separates from the photoconductive member and transfer the developer image on the photoconductive member onto a sheet, a driving mechanism including a rotating lever and configured to drive the transfer belt between the first position and the second position, a shutter unit configured to open and close a light emission surface of the light irradiation unit, and a power transmission mechanism configured to drive the shutter unit by the torque of the lever.

19 Claims, 7 Drawing Sheets

PHOTOCONDUCTIVE IMAGE FORMING APPARATUS WITH RETRACTABLE SHUTTER UNIT

CROSS-REFERENCE TO RELATED APPLICATION

This application is also based upon and claims the benefit of priority from U.S. provisional application 61/184,713, filed on Jun. 5, 2009; the entire contents of which are incorporated herein by reference.

FIELD

This specification relates to an image forming apparatus including a shutter unit configured to partition a photoconductive member from a light irradiation unit configured to irradiate light for exposing the photoconductive member.

BACKGROUND

There is an image forming apparatus in which an exposure unit configured to expose a photoconductive drum to light is located below the photoconductive drum. A shutter unit is arranged between the exposure unit and the photoconductive drum in order to prevent a toner from falling and adhering to a light emission surface (e.g., an emission glass) of the exposure unit. When the shutter unit covers the light emission surface of the exposure unit, the adhesion of the toner to the light emission surface can be prevented. When the shutter unit retracts from the light emission surface, a laser beam of the exposure unit is transmitted through the light emission surface and reaches the photoconductive drum.

DETAILED DESCRIPTION

According to an embodiment, an image forming apparatus includes: a photoconductive member; a light irradiation unit located below the photoconductive member and configured to irradiate light on the surface of the photoconductive member and form an electrostatic latent image; a developing unit configured to supply a developer to the photoconductive member and form a developer image corresponding to the electrostatic latent image on the surface of the photoconductive member; a transfer belt configured to move between a first position where the transfer belt comes into contact with the photoconductive member and a second position where the transfer belt separates from the photoconductive member and transfer the developer image on the photoconductive member onto a sheet; a driving mechanism including a rotating lever and configured to drive the transfer belt between the first position and the second position; a shutter unit located between the photoconductive member and the light irradiation unit and configured to open and close a light emission surface of the light irradiation unit; and a power transmission mechanism configured to transmit the torque of the lever to the shutter unit and drive the shutter unit.

An embodiment is explained below with reference to the accompanying drawings.

Figure 1:
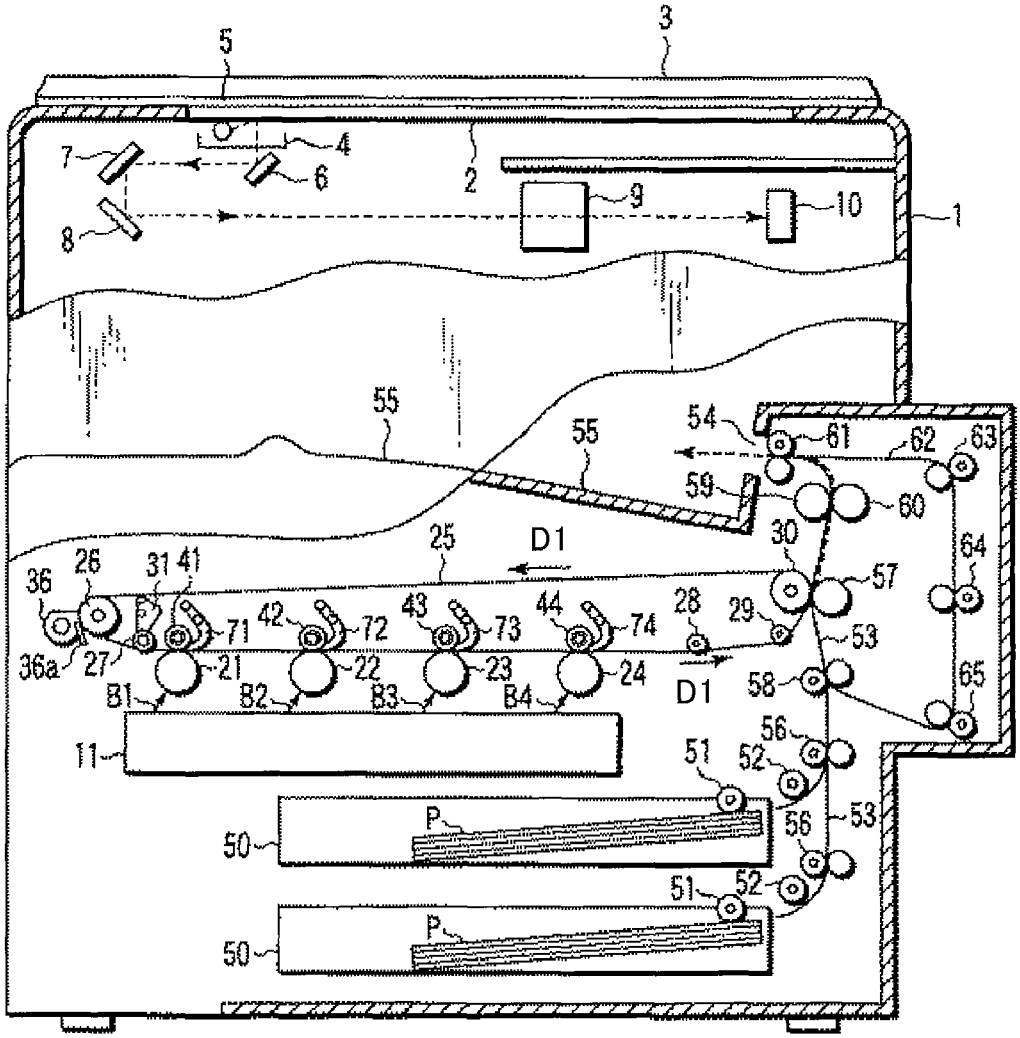
FIG. 1 is a perspective view of an image forming apparatus according to an embodiment.

An image forming apparatus according to the embodiment is explained with reference to FIG. 1. FIG. 1 is a schematic diagram of the internal structure of the image forming apparatus.

A transparent document table (a glass plate) 2 for placing an original document is located in an upper part of a main body 1 of the image forming apparatus. A cover 3 opens and closes the upper surface of the document table 2. A carriage 4 is located on the lower surface side of the document table 2. The carriage 4 reciprocatingly moves along the lower surface of the document table 2. The carriage 4 includes an exposure lamp 5.

While the carriage 4 moves, the exposure lamp 5 is turned on to thereby expose an original document on the document table 2 to light. A reflected light image of the original document is obtained by the exposure of the original document. The reflected light image is focused on an imaging element (e.g., a CCD) 10 by reflection mirrors 6, 7, and 8 and a lens block for magnification 9. The imaging element 10 outputs an image signal corresponding to the reflected light image of the original document.

The carriage 4, the exposure lamp 5, the reflection mirrors 6 to 8, the lens block for magnification 9, and the imaging element 10 are included in a scan unit configured to optically read an image of the original document placed on the document table 2.

An image signal output by the imaging element 10 is input to an exposure unit 11 after being subjected to image processing. The exposure unit 11 projects laser beams B1 to B4 to photoconductive drums (photoconductive members) 21 to 24 corresponding to the laser beams B1 to B4. The exposure unit 11 is located below the photoconductive drums 21 to 24.

The laser beam B1 corresponds to an image signal of yellow and the laser beam B2 corresponds to an image signal of magenta. The laser beam B3 corresponds to an image signal of cyan and the laser beam B4 corresponds to an image signal of black. The photoconductive drum 21 corresponds to yellow, the photoconductive drum 22 corresponds to magenta, the photoconductive drum 23 corresponds to cyan, and the photoconductive drum 24 corresponds to black.

The photoconductive drums 21 to 24 are arranged side by side substantially in the horizontal direction at fixed intervals. A transfer belt 25 is located above the photoconductive drums 21 to 24. The transfer belt 25 is set in contact with a drive roller 26, guide rollers 27, 28, and 29, and a driven roller 30. The drive roller 26 drives the transfer belt 25 in a direction indicated by an arrow D1.

The guide roller 27 moves in an up to down direction of the image forming apparatus (an up to down direction in FIG. 1).

The guide roller 27 presses the transfer belt 25 against the photoconductive drums 21 to 24 according to the rotation of a cam 31.

Primary transfer rollers 41, 42, 43, and 44 are respectively opposed to the photoconductive drums 21 to 24 across the transfer belt 25 and move in the up to down direction of the image forming apparatus. The primary transfer rollers 41 to 44 move downward, whereby the transfer belt 25 comes into contact with the photoconductive drums 21 to 24.

Figure 2:
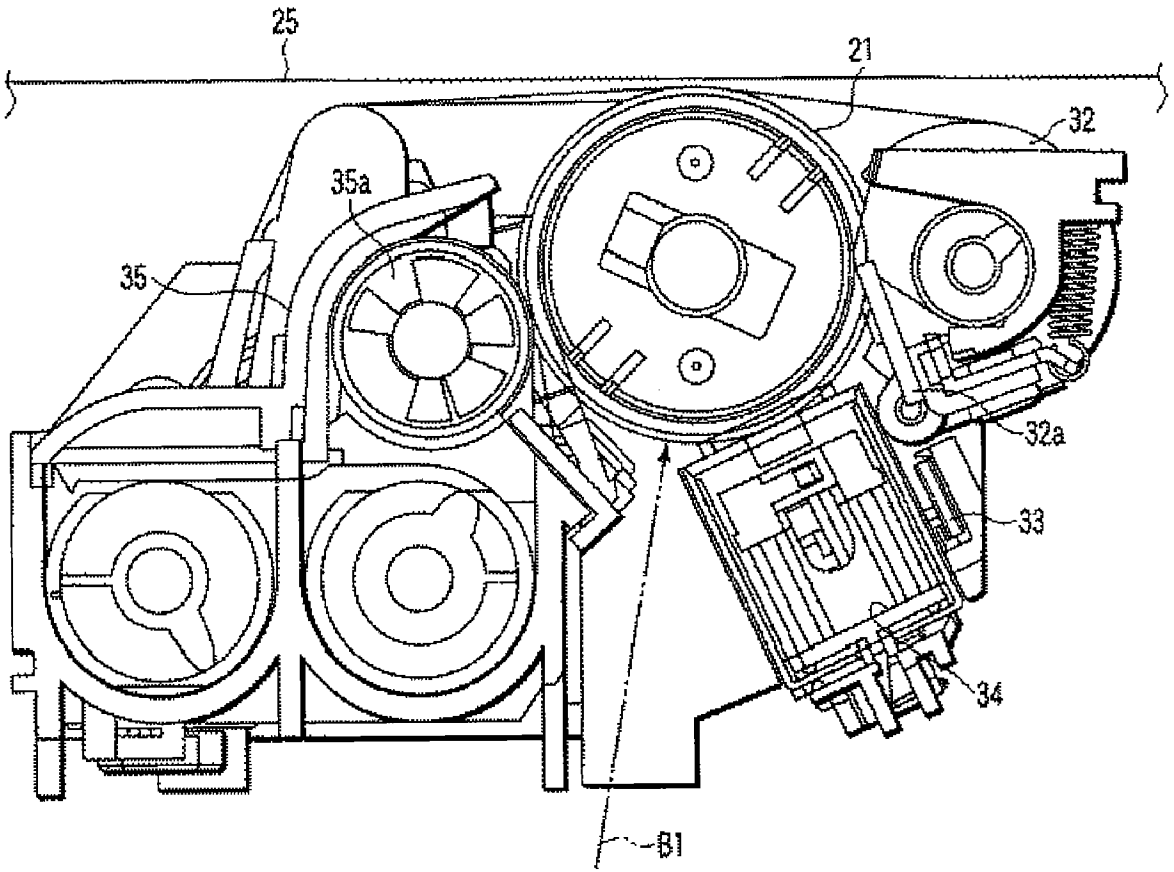
FIG. 2 is a diagram of a photoconductive drum and the peripheral structure of the photoconductive drum in the embodiment.

FIG. 2 is a diagram of the photoconductive drum 21 and the peripheral structure of the photoconductive drum 21. A cleaner 32, a charge removing lamp 33, a charging unit 34, and a developing unit 35 are located around the photoconductive drum 21. The cleaner 32 includes a cleaning blade 32*a* set in contact with the surface of the photoconductive drum 21. The cleaning blade 32*a* scrapes off a developer remaining on the surface of the photoconductive drum 21. The charge removing lamp 33 removes charges remaining on the surface of the photoconductive drum 21.

The charging unit 34 applies high voltage to the photoconductive drum 21 to thereby generate electrostatic charges on the surface of the photoconductive drum 21. The laser beam B1 from the exposure unit 11 reaches the surface of the photoconductive drum 21 after the charging. An electrostatic latent image is formed on the surface of the photoconductive drum 21 by the irradiation of the laser beam B1.

The developing unit 35 contains yellow developer (toner) and includes a developing roller 35*a* set in contact with the surface of the photoconductive drum 21. The developing roller 35*a* rotates according to the rotation of the photoconductive drum 21 to thereby supply the developer to the photoconductive drum 21. On the surface of the photoconductive drum 21, the electrostatic latent image is visualized and a developer image is generated.

Developer images formed on the surfaces of the photoconductive drums 21 to 24 are transferred onto the transfer belt 25 by the primary transfer rollers 41 to 44.

In this embodiment, the cleaner 32 and the developing unit 35 can move with respect to the photoconductive drum 21 and can be removed from the main body 1 of the image forming apparatus. The other photoconductive drums 22, 23, and 24 and the peripheral structures of the photoconductive drums 22, 23, and 24 are the same as those shown in FIG. 2. Therefore, detailed explanation thereof is omitted.

In FIG. 1, plural paper feeding cassettes 50 are located below the exposing unit 11. The paper feeding cassettes 50 store a large number of sheets P. Pickup rollers 51 extract the sheets P from the paper feeding cassettes 50 one by one. Separation rollers 52 separate the sheets P from the paper feeding cassettes 50 and supply the sheets to a conveying path 53.

The conveying path 53 extends to a paper discharge port 54 through the driven roller 30. The discharge port 54 is directed to a paper discharge tray 55 that continues to the outer peripheral surface of the main body 1.

Paper feeding rollers 56 are located near the separation rollers 52. A secondary transfer roller 57 is opposed to the driven roller 30 across the transfer belt 25. A registration roller 58 is located on an upstream side on the conveying path 53 with respect to the driven roller 30 and the secondary transfer roller 57. The registration roller 58 feeds the sheet P to between the transfer belt 25 and the secondary transfer roller 57 to be timed to coincide with the rotation of the transfer belt 25. The secondary transfer roller 57 transfers the developer image on the transfer belt 25 onto the sheet P.

On the conveying path 53, a heat roller 59 for fixing and a pressing roller 60 set in contact with the heat roller 59 are located further on a downstream side than the secondary transfer roller 57. A paper discharge roller 61 is located at the terminal end of the conveying path 53.

When the sheet P moves through a conveying path 62, the sheet P is reversed. Paper feeding rollers 63, 64, and 65 are located on the conveying path 62. The sheet P that reaches the terminal end of the conveying path 53 passes through the conveying path 62 and returns to the conveying path 53, whereby the developer image on the transfer belt 25 is also transferred onto the rear surface of the sheet P.

A cleaner 36 is opposed to the drive roller 26 across the transfer belt 25. The cleaner 36 includes a cleaning blade 36*a* set in contact with the transfer belt 25. The cleaning blade 36*a* scrapes off the developer remaining on the transfer belt 25.

Figure 3:
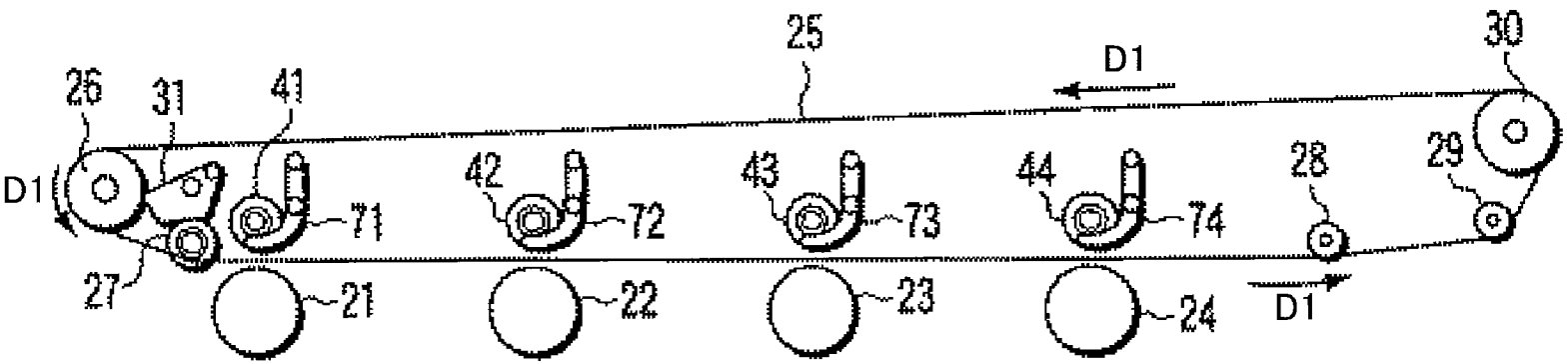
FIG. 3 is a diagram of a state in which a transfer belt is separated from the photoconductive drum in the embodiment.

Hooks 71, 72, 73, and 74 are located near the primary transfer rollers 41 to 44. The hooks 71 to 74 are respectively located on both end sides of the primary transfer rollers 41 to 44. As shown in FIG. 3, the hooks 71 to 74 lift shafts of the primary transfer rollers 41 to 44 while rotating, whereby the primary transfer rollers 41 to 44 move upward. The transfer belt 25 separates from all the photoconductive drums 21 to 24.

A structure for driving the primary transfer rollers 41 to 44 (the hooks 71 to 74) is explained with reference to FIG. 4.

Figure 4:
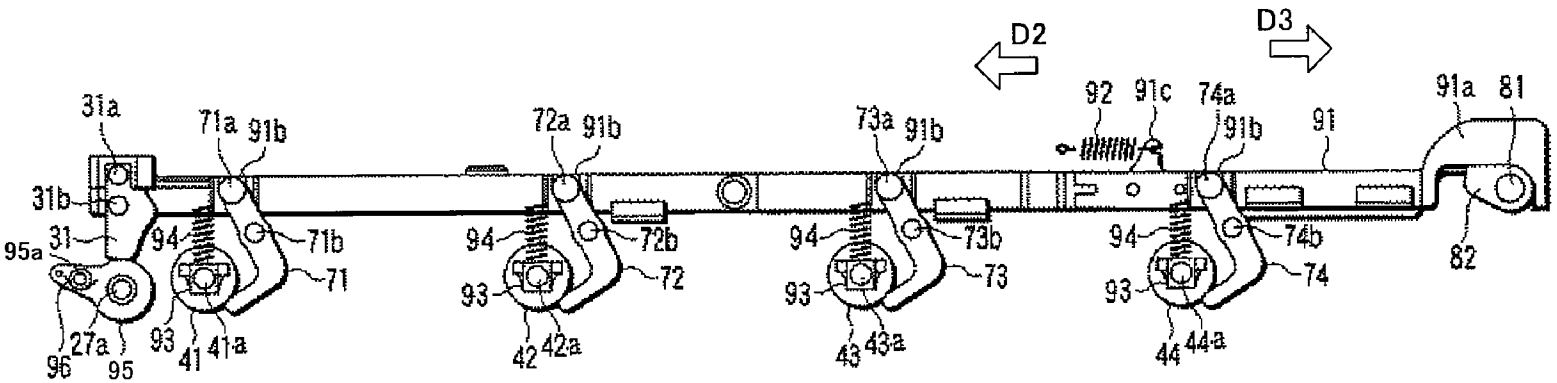
FIG. 4 is a diagram of a driving mechanism for a primary transfer roller in the embodiment.

A shaft 81 extends in a direction orthogonal to the paper surface of FIG. 4. The length of the shaft 81 is substantially the same as the length in an axis direction of the primary transfer rollers 41 to 44. The axis direction of the shaft 81 is parallel to an axis direction of the primary transfer rollers 41 to 44. The shaft 81 has cams 82 at both ends in a longitudinal direction thereof.

According to the rotation of the cam 82 at one end, a lever 91 reciprocatingly moves in a left to right direction in FIG. 4. The lever 91 has, at one end, a cam housing section 91*a* configured to house the cam 82. The lever 91 has, on a side, a groove 91*b* configured to house an interlocking shaft 74*a* of the hook 74. A spring 92 is engaged with a hook 91*c* located on the upper surface of the lever 91 and urges the lever 91 in a direction of an arrow D2 shown in FIG. 4.

When the shaft 81 rotates, the cam 82 rotates while pushing the inner peripheral surface of the cam housing section 91*a*. The lever 91 moves in a direction of an arrow D3 shown in FIG. 4 while resisting the urging force of the spring 92. When the lever 91 moves in the direction of the arrow D3, the interlocking shaft 74*a* of the hook 74 moves in the same direction. The hook 74 rotates around a supporting shaft 74*b*. The lower end of the hook 74 engages with a shaft 44*a* of the primary transfer roller 44 and lifts the shaft 44*a*. The primary transfer roller 44 moves upward and separates from the transfer belt 25.

The shaft 44*a* is coupled to a roller supporting piece 93. A spring 94 is coupled to an upper surface section of the roller supporting piece 93. The spring 94 urges the roller supporting piece 93 downward. The hook 74 lifts the shaft 44*a* of the primary transfer roller 44 while resisting the urging force of the spring 94.

When the cam 82 rotates and stops pushing the inner peripheral surface of the cam housing section 91*a*, the lever 91 receives the urging force of the spring 92 and moves in the direction of the arrow D2 shown in FIG. 4. According to the movement of the lever 91, the interlocking shaft 74*a* of the hook 74 moves in the same direction and the hook 74 rotates around the supporting shaft 74*b* and disengages from the shaft 44*a*. When the hook 74 and the shaft 44*a* are disengaged, the primary transfer roller 44 receives the urging force of the spring 94 and moves downward. The transfer belt 25 is pushed by the primary transfer roller 44 and comes into contact with the photoconductive drum 24.

The same structure (the lever 91, the spring 92, the hook 74, the roller supporting piece 93, and the spring 94) is provided with respect to the cam 82 at the other end of the shaft 81. Detailed explanation of the structure is omitted. The hooks 71, 72, and 73 have the same structure as the hook 74. The lever 91 drives interlocking shafts 71*a*, 72*a*, and 73*a* of the hooks 71, 72, and 73. The hooks 71, 72, and 73 rotate around supporting shafts 71*b*, 72*b*, and 73*b*. The hooks 71, 72, and 73 rotate to push up shafts 41*a*, 42*a*, and 43*a* of the primary transfer rollers 41, 42, and 43 and disengage from the shafts 41*a*, 42*a*, and 43*a*.

When the lever 91 moves in the direction of the arrow D3 shown in FIG. 4, an interlocking shaft 31*a* of the cam 31 moves in the same direction and the cam 31 rotates around a shaft 31*b*. The cam 31 is set in contact with a roller supporting member 95. In a state shown in FIG. 4, the cam 31 presses the roller supporting member 95 downward. In the state shown in FIG. 4, when the interlocking shaft 31*a* of the cam 31 moves in the direction of the arrow D3, the cam 31 rotates and releases the pressing on the roller supporting member 95.

A shaft 27*a* of the guide roller 27 is engaged with the roller supporting member 95. When the pressing on the roller supporting member 95 is released, the roller supporting member 95 receives the urging force of a spring 96 and rotates around a supporting shaft 95*a*. According to the rotation of the roller supporting member 95, the shaft 27*a* moves upward and the guide roller 27 moves upward. The guide roller 27 moves upward to thereby release pressing on the transfer belt 25 by the guide roller 27.

After the guide roller 27 moves upward, when the lever 91 moves in the direction of the arrow D2 shown in FIG. 4, the lever 91 returns to the state shown in FIG. 4.

In this embodiment, the four hooks 71 to 74 are driven by using one lever 91. However, it is also possible to separately move the hooks 71 to 74 using plural levers.

Figure 5:
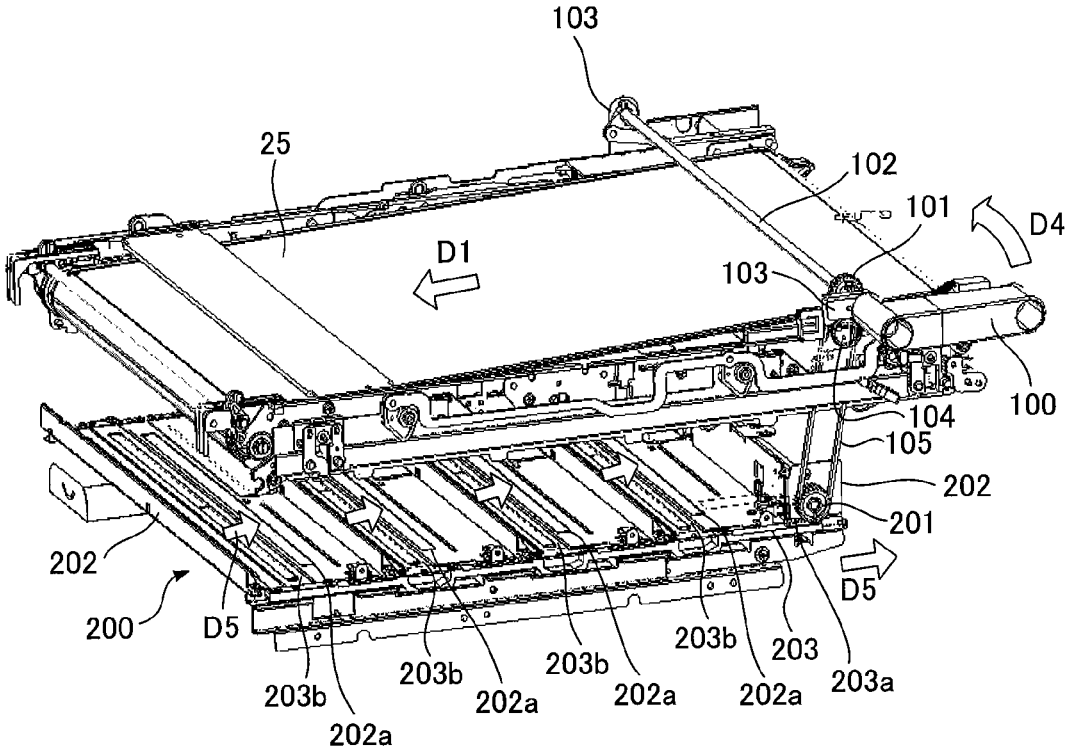
FIG. 5 is a diagram of a driving mechanism for the transfer belt and a driving mechanism for a shutter unit in the embodiment, wherein the transfer belt is set in contact with the photoconductive drum.

A lever 100 shown in FIG. 5 is coupled to the shaft 81 via a gear train. A gear 101 is a part of the gear train. A shaft 102 is coupled to the proximal end of the lever 100. A supporting member 103 supports both ends of the shaft 102. The lever 100 rotates around the shaft 102. The gear 101 rotates according to the rotation of the shaft 102.

A state shown in FIG. 5 corresponds to the state shown in FIG. 1. The transfer belt 25 is set in contact with the photoconductive drums 21 to 24. The gear 101 also meshes with a first pulley 104. The torque of the gear 101 is transmitted to the first pulley 104. The supporting member 103 supports the first pulley 104. The first pulley 104 rotates with respect to the supporting member 103. The first pulley 104 has a section that meshes with the gear 101 and a section that meshes with a belt 105.

The belt 105 extends further downward than the first pulley 104 and meshes with a second pulley 201 of a shutter unit 200. The second pulley 201 is located below the first pulley 104. In other words, when viewed from the up to down direction of the image forming apparatus, the first pulley 104 and the second pulley 201 partially overlap each other.

The torque of the first pulley 104 is transmitted to the second pulley 201 via the belt 105. The second pulley 201 rotates. A part of a base member 202 of the shutter unit 200 supports the second pulley 201. The second pulley 201 rotates with respect to the base member 202. The second pulley 201 has a section that meshes with the belt 105 and a section that meshes with a gear section 203*a* of a shutter plate 203.

The shutter plate 203 has four blocking sections 203*b*. The four blocking sections 203*b* respectively correspond to the photoconductive drums 21 to 24. The blocking sections 203*b* are used to close and open openings 202*a* of the base member 202. The base member 202 guides the shutter plate 203 such that the shutter plate 203 reciprocatingly moves along one direction.

The base member 202 has four openings 202*a*. The four openings 202*a* respectively correspond to the photoconductive drums 21 to 24. The laser beams B1 to B4 for exposing the photoconductive drums 21 to 24 pass through the openings 202*a*.

Figure 6:
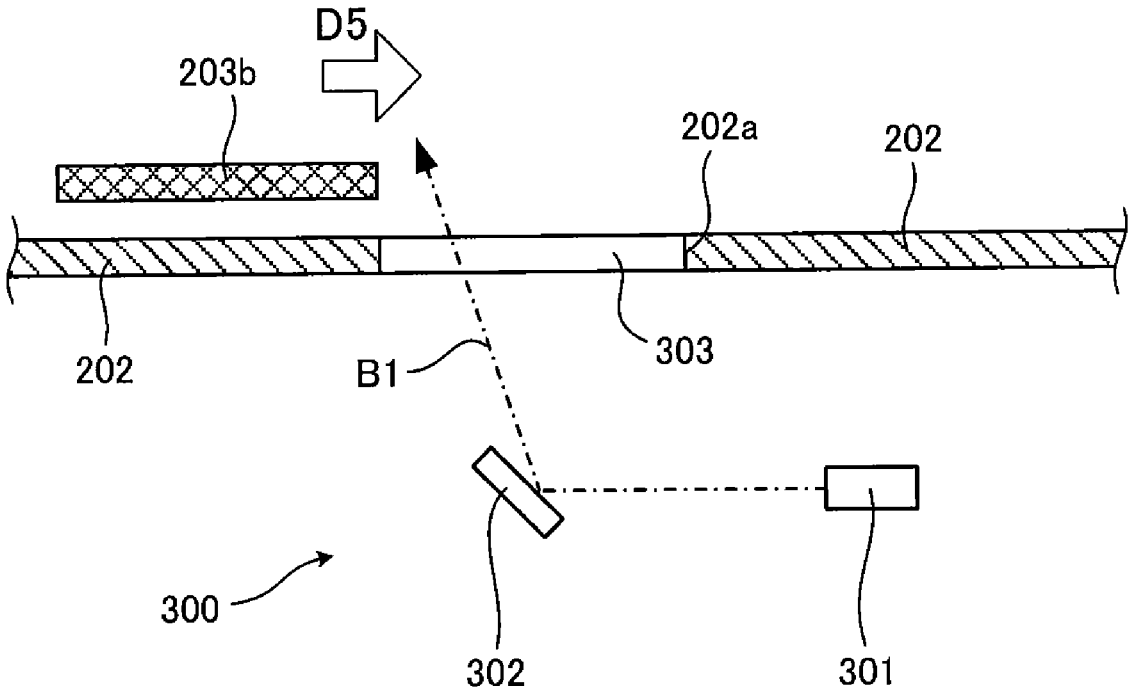
FIG. 6 is a schematic diagram of the configurations of a laser irradiation unit and the shutter unit in the embodiment.

In the state shown in FIG. 5, the blocking sections 203*b* retract from the openings 202*a*. As shown in FIG. 6, a laser irradiation unit (a light irradiation unit) 300 is located below the shutter unit 200. A state shown in FIG. 6 corresponds to the state shown in FIG. 5. The exposure unit 11 shown in FIG. 1 includes the shutter unit 200 and the laser irradiation unit 300.

The laser irradiation unit 300 includes a light source 301 and a folding mirror 302. The light source 301 generates the laser beams B1 to B4 irradiated on the photoconductive drums to 24. In FIG. 6, the laser irradiation unit 300 corresponding to the photoconductive drum 21 is shown.

The folding mirror 302 reflects, to the photoconductive drum 21, the laser beam B1 from the light source 301. The laser beam B1 reflected by the folding mirror 302 is transmitted through an emission glass 303. The emission glass 303 has a flat shape and is located in the opening 202*a* of the base member 202. The emission glass 303 extends in a scanning direction (a direction orthogonal to the paper surface of FIG. 6) in which the laser beam B1 exposes the photoconductive drum 21. The laser beam B1 transmitted through the emission glass 303 reaches the photoconductive drum 21.

In the state shown in FIG. 5, when the lever 100 rotates in a direction of an arrow D4, as explained with reference to FIGS. 3 and 4, the transfer belt 25 separates from the photoconductive drums 21 to 24. The lever 100 is operated by a user. When the transfer belt 25 separates from the photoconductive drums 21 to 24, the developing unit 35 and the cleaner 32 (see FIG. 2) can be removed from the image forming apparatus.

The torque of the lever 100 reaches the shutter plate 203 via the gear 101, the first pulley 104, the belt 105, and the second pulley 201. The shutter plate 203 receives the torque of the lever 100 and moves in a direction of an arrow D5 shown in FIG. 5. Since the shutter plate 203 has the blocking sections 203*b*, the blocking sections 203*b* also move in the direction of the arrow D5.

Figure 7:
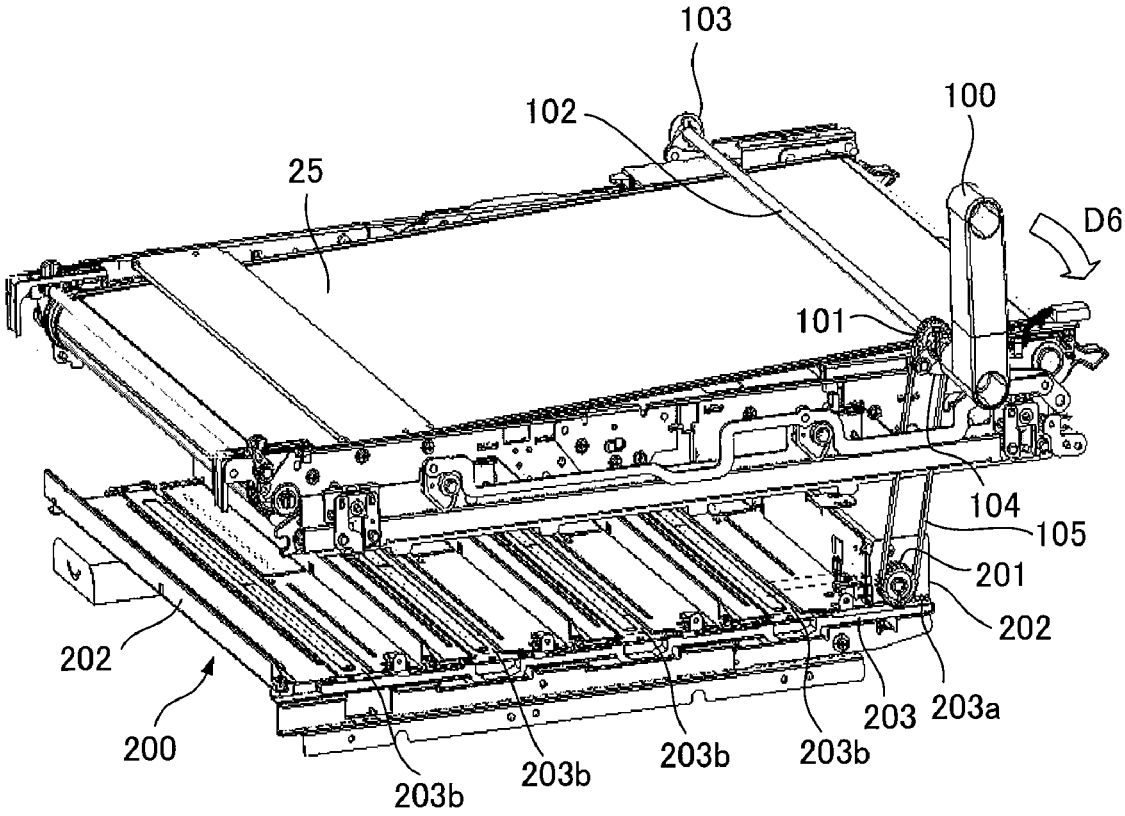
FIG. 7 is a diagram of the driving mechanism for the transfer belt and the driving mechanism for the shutter unit in the embodiment, wherein the transfer belt is separated from the photoconductive drum.

The lever 100 can rotate up to a position shown in FIG. 7. When the lever 100 rotates to the position shown in FIG. 7, the shutter plate 203 (the blocking sections 203*b*) closes the openings 202*a*. When the shutter plate 203 closes the openings 202*a*, the laser beam B1 does not reach the photoconductive drum 21. When a developer falls from the photoconductive drum 21 and the like (including the developing unit 35 and the cleaner 32), it is possible to prevent the developer from adhering to the emission glass 303.

When the cleaner 32 and the developing unit 35 are removed from the photoconductive drum 21, the developer tends to fall. When the cleaner 32 and the developing unit 35 are removed, the lever 100 rotates from the position shown in FIG. 5 to the position shown in FIG. 7, whereby the transfer belt 25 separates from the photoconductive drums 21 to 24.

In a state shown in FIG. 7, when the lever 100 rotates in a direction of an arrow D6, the lever 100 returns to the state shown in FIG. 5. The transfer belt 25 comes into contact with the photoconductive drums 21 to 24. The shutter plate 203 retracts from the openings 202*a*.

In this embodiment, the torque of the lever 100 is transmitted to the shutter plate 203 by using the pulleys 104 and 201 and the belt 105. However, other power transmission mechanisms can also be used. A mechanism that can mechanically couple the lever 100 and the shutter plate 203 and convert rotational motion of the lever 100 into linear motion of the shutter plate 203 only has to be used. For example, it is possible to transmit the torque of the lever 100 to the shutter plate 203 using a gear train including plural gears.

According to this embodiment, it is possible to drive the shutter plate 203 using the torque of the lever 100. A motor can also be used to drive the shutter plate 203. However, when the motor is used, a component for controlling the driving of the motor is necessary. For example, a sensor for detecting a rotation state of the motor is necessary. In this embodiment, the lever 100 and the shutter plate 203 are simply coupled mechanically. Therefore, a configuration can be simplified compared with a configuration in which the motor is used.

When the lever 100 is operated to remove the developing unit 35 and the like, the shutter plate 203 closes the openings 202*a*. Therefore, when the developing unit 35 and the like are removed, it is possible to prevent the developer from falling and adhering to the emission glass 303.

The present invention can be carried out in other various forms without departing from the spirit or the main characteristics of the present invention. Therefore, the embodiment is only an exemplar in every aspect and should not be limitedly interpreted. The scope of the present invention is indicated by the scope of claims and is by no means restricted by the text of the specification. Further, all modifications and various improvements, substitutions, and alterations belonging to the scope of equivalents of the scope of claims are within the scope of the present invention.

While certain embodiments have been described, these embodiments have been presented by way of example only, and are not intended to limit the scope of invention. Indeed, the novel apparatus and methods described herein may be embodied in a variety of other forms; furthermore, various omissions, substitutions and changes in the form of the apparatus and methods described herein may be made without departing from the sprit of the inventions. The accompanying claims and their equivalents are intended to cover such forms or modifications as would fall within the scope and spirit of the inventions.

What is claimed is:

1. An image forming apparatus comprising:

a photoconductive member;

a light irradiation unit located below the photoconductive member and configured to irradiate light on a surface of the photoconductive member and form an electrostatic latent image;

a developing unit configured to supply a developer to the photoconductive member and form a developer image corresponding to the electrostatic latent image on the surface of the photoconductive member;

a transfer belt configured to move between a first position where the transfer belt comes into contact with the photoconductive member and a second position where the transfer belt separates from the photoconductive member and transfer the developer image on the photoconductive member onto a sheet;

a driving mechanism including a rotating lever and configured to drive the transfer belt between the first position and the second position;

a shutter unit located between the photoconductive member and the light irradiation unit and configured to open and close a light emission surface of the light irradiation unit; and a power transmission mechanism configured to transmit torque of the lever to the shutter unit and drive the shutter unit.

2. The apparatus according to claim 1, wherein the shutter unit includes a shutter plate configured to move along the light emission surface, and the power transmission mechanism converts the torque of the lever into linear motion of the shutter plate.

3. The apparatus according to claim 1, wherein the power transmission mechanism includes:

a first pulley located on a side of the lever;

a second pulley located on a side of the shutter unit; and a belt configured to engage with the first pulley and the second pulley.

4. The apparatus according to claim 3, further comprising a gear configured to rotate together with the lever around a rotating shaft of the lever, wherein the first pulley has a gear section that meshes with the gear.

5. The apparatus according to claim 3, wherein the shutter unit has a gear section, and the second pulley has a gear section that meshes with the gear section of the shutter unit.

6. The apparatus according to claim 3, wherein the first pulley and the second pulley are arranged side by side in a vertical direction of the image forming apparatus.

7. The apparatus according to claim 3, wherein the belt extends in a vertical direction of the image forming apparatus.

8. The apparatus according to claim 1, wherein the developing unit can be removed from the image forming apparatus when the transfer belt moves to the second position.

9. The apparatus according to claim 1, further comprising a cleaner that is configured to scrape off the developer remaining on the surface of the photoconductive member and can be removed from the image forming apparatus when the transfer belt moves to the second position.

10. The apparatus according to claim 1, wherein a plurality of the photoconductive members are arranged side by side along the transfer belt, and the shutter unit opens and closes light emission surfaces of the light irradiation unit corresponding to the photoconductive members.

11. The apparatus according to claim 1, further comprising a fixing unit configured to heat the sheet, onto which the developer image is transferred from the transfer belt, and fix the developer image on the sheet.

12. An exposing device comprising:

a light irradiation unit located below a photoconductive member and configured to irradiate light on a surface of the photoconductive member and form an electrostatic latent image;

a shutter unit located between the photoconductive member and the light irradiation unit and configured to open and close a light emission surface of the light irradiation unit; and a power transmission mechanism configured to transmit, to the shutter unit, force for driving a transfer belt between a first position where the transfer belt comes into contact with the photoconductive member and a second position where the transfer belt separates from the photoconductive member and drive the shutter unit.

13. The device according to claim 12, wherein the force for driving the transfer belt is an operation force input to a lever when the transfer belt is driven between the first position and the second position.

14. The device according to claim 13, wherein the shutter unit includes a shutter plate configured to move along the light emission surface, and the power transmission mechanism converts torque of the lever into linear motion of the shutter plate.

15. The device according to claim 13, wherein the power transmission mechanism includes:

a first pulley located on a side of the lever;

a second pulley located on a side of the shutter unit; and a belt configured to engage with the first pulley and the second pulley.

16. The device according to claim 12, wherein a plurality of the photoconductive members are arranged side by side along the transfer belt, and the shutter unit opens and closes light emission surfaces of the light irradiation unit corresponding to the photoconductive members.

17. A driving device comprising:

a driving mechanism including a rotating lever and configured to drive a transfer belt between a first position where the transfer belt comes into contact with a photoconductive member and a second position where the transfer belt separates from the photoconductive member; and a power transmission mechanism configured to transmit torque of the lever to a shutter unit located between the photoconductive member and a light irradiation unit and drive the shutter unit, the light irradiation unit being located below the photoconductive member, irradiating light on a surface of the photoconductive member, and forming a latent image.

18. The device according to claim 17, wherein the power transmission mechanism includes:

a first pulley located on a side of the lever;

a second pulley located on a side of the shutter unit; and a belt configured to engage with the first pulley and the second pulley.

19. An image forming method comprising:

irradiating light on a surface of a photoconductive member from a light irradiation unit located below the photoconductive member and forming an electrostatic latent image;

supplying a developer to the photoconductive member and forming a developer image corresponding to the electrostatic latent image on the surface of the photoconductive member;

transferring the developer image on the photoconductive member onto a sheet via a transfer belt when the transfer belt comes into contact with the photoconductive member;

fixing the developer image transferred onto the sheet on the sheet; and transmitting force for driving the transfer belt in a direction away from the photoconductive member to a shutter unit located between the photoconductive member and the light irradiation unit and switching a light emission surface of the light irradiation unit from an open state to a closed state.

* * * * *